United States Patent [19]

Banko

[11] 3,943,995

[45] Mar. 16, 1976

[54] DAMPER ARRANGEMENT FOR CONTROLLING AIR OR FLUID FLOW

[76] Inventor: Edward J. Banko, 82 Longfellow Drive, Colonia, N.J. 07067

[22] Filed: Feb. 19, 1974

[21] Appl. No.: 443,731

[52] U.S. Cl. ..... 165/101; 137/625.29; 137/625.33; 165/35; 165/103

[51] Int. Cl.[2] ..... F01P 7/10

[58] Field of Search ..... 165/103, 101, 98, 35; 98/41, 41 SV; 137/625.29, 625.33

[56] References Cited

UNITED STATES PATENTS

| | | | |
|---|---|---|---|
| 3,034,531 | 5/1962 | Kennedy | 98/41 R |
| 3,107,724 | 10/1963 | Horn | 165/34 |
| 3,443,588 | 5/1969 | Banko | 98/41 R |
| 3,522,841 | 8/1970 | Papalexiou | 165/103 |
| 3,627,033 | 12/1971 | Ringquist | 165/103 |

FOREIGN PATENTS OR APPLICATIONS

| | | | |
|---|---|---|---|
| 1,321,953 | 2/1963 | France | 165/103 |
| 1,093,973 | 12/1960 | Germany | 165/103 |

*Primary Examiner*—Charles J. Myhre
*Assistant Examiner*—Daniel J. O'Connor
*Attorney, Agent, or Firm*—David H. Tannenbaum

[57] ABSTRACT

The arrangement of the individual air dampers with respect to the heating coils in a vertical tube face and bypass air treatment unit such that the dampers each move laterally across the coils results in a substantial reduction in the number of moving parts required to control air flow around the coils. Selective proportioning of the air flow is accomplished by splitting each damper into two sections and permanently fixing one section with respect to the coil set while allowing the other section to slide across the face of the coil set in mating relationship with the fixed section.

19 Claims, 15 Drawing Figures

DAMPER ARRANGEMENT FOR CONTROLLING AIR OR FLUID FLOW

FIELD OF THE INVENTION

This invention relates to air treatment units where air or other fluids move past conditioning coils and, more particularly, to an arrangement for selectively controlling the volume of such fluid passing certain portions of the conditioning coils.

BACKGROUND OF THE INVENTION

One well-known method of treating large volumes of air is to move the air over heating coils so as to impart units of heat energy to the moving air. Such an arrangement is particularly useful when large internal areas are to be heated and where fresh outside air is to be used in the heating system. In such an arrangement the outside air is passed through a conditioning unit where a number of coil sets are contained, each set being internally heated so that as the fresh air passes heat units are transferred to the air thereby raising the temperature of the air.

As the ambient temperature of the outside or fresh air changes the amount of heat which must be transferred to the air in order to maintain a given final air temperature also changes. One method of accomplishing control of this heat in the past has been to control the incoming air so that a portion passes directly through and in face contact with the hot coils and a portion bypasses the coils, with the exact proportions depending on the ambient temperature and the desired final temperature. In the prior art, pivotaly mounted dampers have been used to accomplish such a proportioning of the air flow.

One problem with the pivotal arrangements is the large number of moving parts required to make all of the dampers move in synchronism with each other. Since the dampers are constructed with mating pairs of baffles around each coil set, it is necessary to move both portions of each baffle pair in opposite directions in order to achieve the desired selective proportioning. One example of such an arrangement is shown in U.S. Pat. No. 3,489,204 issued to A. Chaloka on Jan. 13, 1970. FIG. 3 of the Chaloka patent clearly shows the complex linkages required to accomplish the necessary movement. FIG. 3 of Chaloka also shows that each movable baffle must be pivotly mounted. Inherently, such a pivotal system is costly to construct, difficult to maintain and inefficient from the standpoint of the amount of energy required to move the baffles. In addition, since each damper comprises four distinct parts, each moving in a different direction with respect to each other, alignment problems are severe and tight air flow seals are difficult to obtain.

A still further problem exists when it is desired to pass air or fluid through different passages of a heat conditioning device; namely, the fact that each passage presents a different impedance to the flow of the fluid and thus the velocity of the fluid becomes a function of the passageway taken by that fluid. Such a result is troublesome in that the fluids passing through different passages will not mix properly thereby defeating the purpose of the selective proportioning device.

Accordingly, it is one object of our invention to arrange the proportioning dampers of an air of fluid treatment unit in a manner eliminating pivotal motion of the damper and in a manner which allows external adjustment of the dampers.

It is another object of our invention to reduce to a minimum the number of moving parts of each damper of an air or fluid treatment unit to a minimum.

And it is a still further object of our invention to provide selectively proportional openings in and around fluid heating coils where the relative velocities of the fluid passing through either opening are the same.

SUMMARY OF THE INVENTION

In the preferred embodiment of the invention there is a plurality of heat transferring devices spaced apart in groups. As shown, an upper and lower steam header are arranged with vertically spaced connecting coils through which steam or other heat carrying means flow so as to provide units of heat for transfer to fluids coming in contact with the coils. This arrangement is the same as the vertically spaced apart coils shown in the aforementioned Chaloka patent. The coils are arranged into groups, each group being separated across the width of the headers from an adjacent group by a space. The area thus defined by the respective spaces between groups of coils is called the bypasss area; while the area immediately around each heating coil is termed the face area. Selective proportioning then occurs when the incoming air of fluid is directed either through the face area or passage directly in contact with the heating coils or through the bypass area or passage between the coil groups.

Dampers are used to accomplish the selective proportioning of the fluid by directing the fluid either into the face passage or into the bypass passage or partially into each. The dampers are arranged having two baffle sections, one baffle section being a fixed section with respect to each group of coils and the other section being a slidable mating section movable across the face of the coil groups. The relative spacing between each movable baffle and its mating fixed baffle then determines the size of the respective face and bypass passages which passages are inversely proportional to each other thereby controlling the amount of fluid moving into the respective passages. When the movable damper baffle is brought into fully mating relationship with the mixed damper baffle, the mating edges of each are arranged to form an air seal which is offset from the center line of the heating coils a distance sufficient for the incoming fluid to provide additional pressure on the seal to further press the mating edges closed thereby insuring a minimum of air leakage into the face passage.

The movable baffles associated with each group of coils are all fixedly attached to a number of parallel spaced apart horizontal members which are arranged to move across the face or width of the headers. These horizontal members are guided and supported in the horizontal and vertical directions by bearing wheels located outside or external to the airstream. Because of the small number of bearing points involved, typically four, the bearing can be relatively elaborate and still not appreciably add to the overall cost or complexity of the apparatus. In fact, due to the drastic reduction in movable parts, greater mechanical efficiencies result and smaller mechanical forces are necessary to move the dampers to a desired position.

Also due to the fact that selective proportioning of the fluid is accomplished by damper baffles which move horizontal to the face of the coils, as opposed to moving in an arc with respect to the coils as do prior art damper baffles, a more directly proportional result is achieved for any given mechanical motion provided to the system.

The weight of the movable dampers and the horizontal supports is supported on wheels at each side of the casing. The guide wheels provide for and maintain accurate alignment of the mating surfaces of the movable and fixed dampers.

Accordingly it is a feature of our invention that the selective proportioning of fluids through a heat treating apparatus is acomplished by a plurality of dampers arranged to move laterally with respect to the heat transferral means.

It is another feature of our invention that the laterally moving dampers of a heat treating apparatus are arranged to control the openings of face and bypass passages of the apparatus in a manner substantially proportional to the amount of mechanical movement provided to the dampers.

It is still another feature of our invention that the laterally moving dampers of a heat treating apparatus are supported and guided to provide good mating and therefore a good air seal between the movable and fixed dampers.

These and other objects and features of our invention will become more fully apparent from the detailed description of the embodiment shown, when taken together with the drawing in which.

Figure 4:
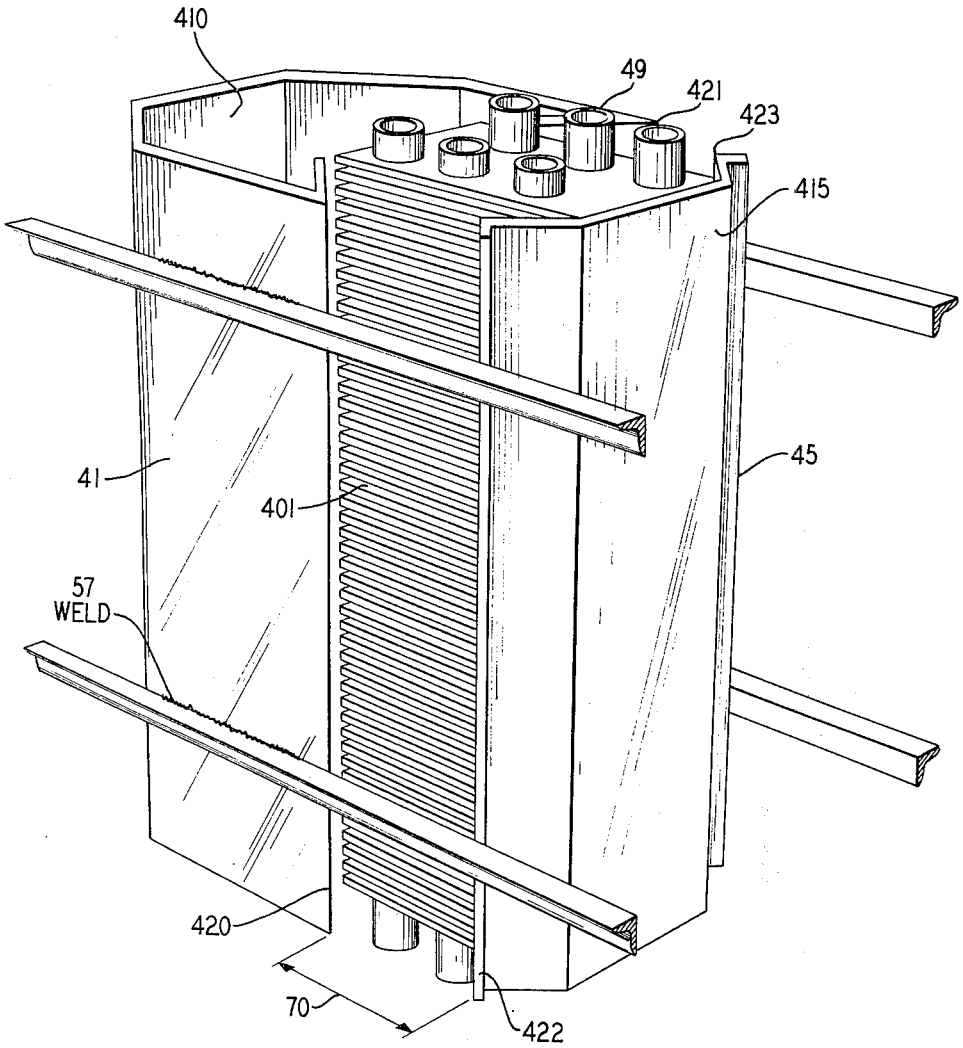
Figure 5:
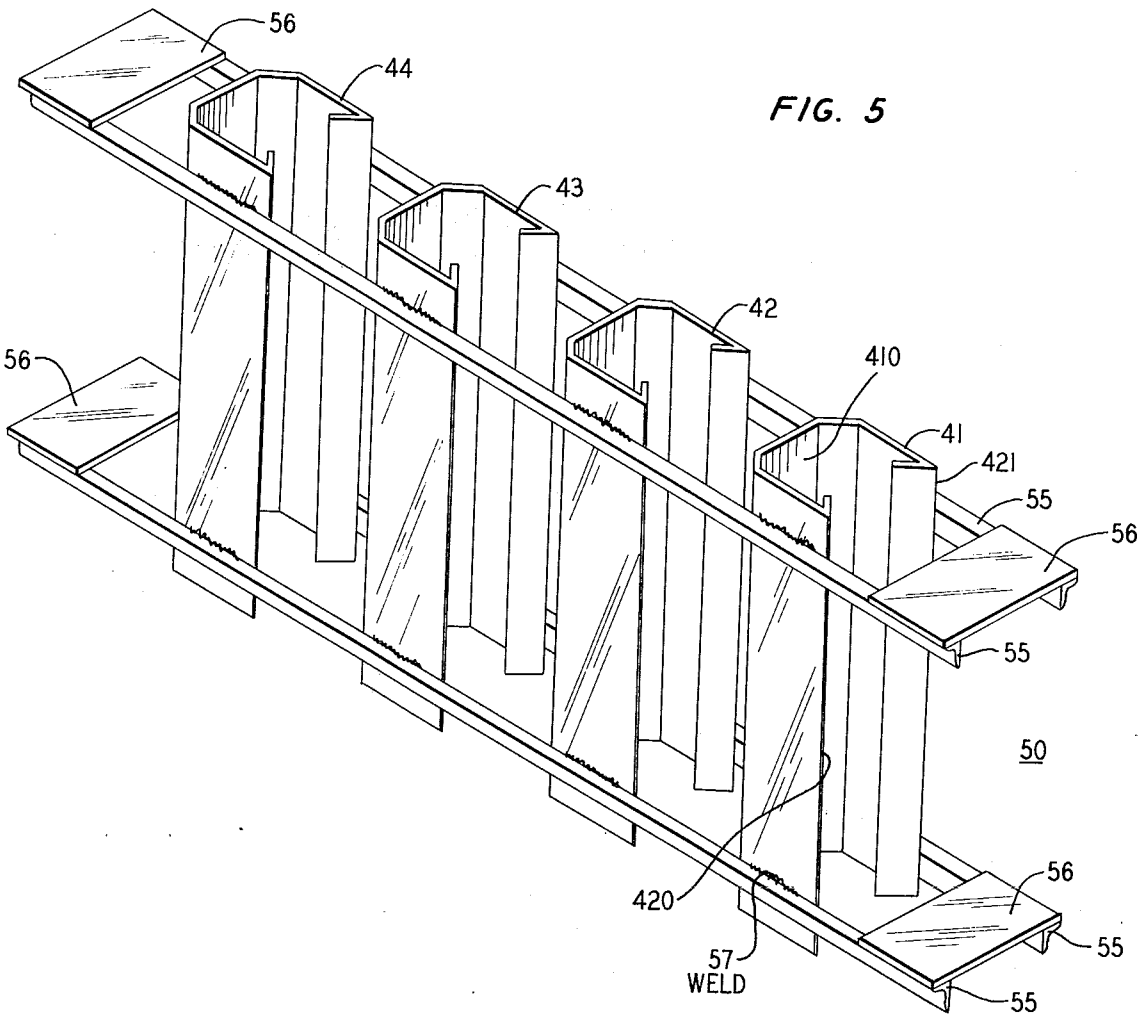
Figure 6A:
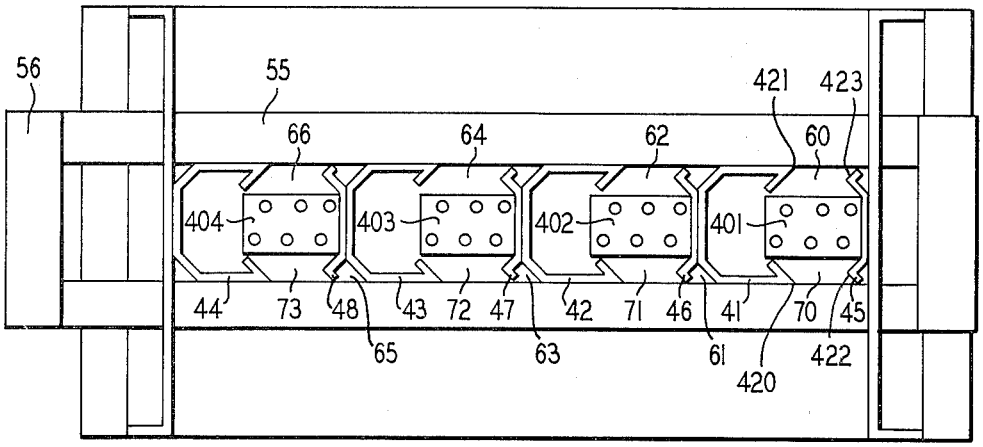
Figure 6B:
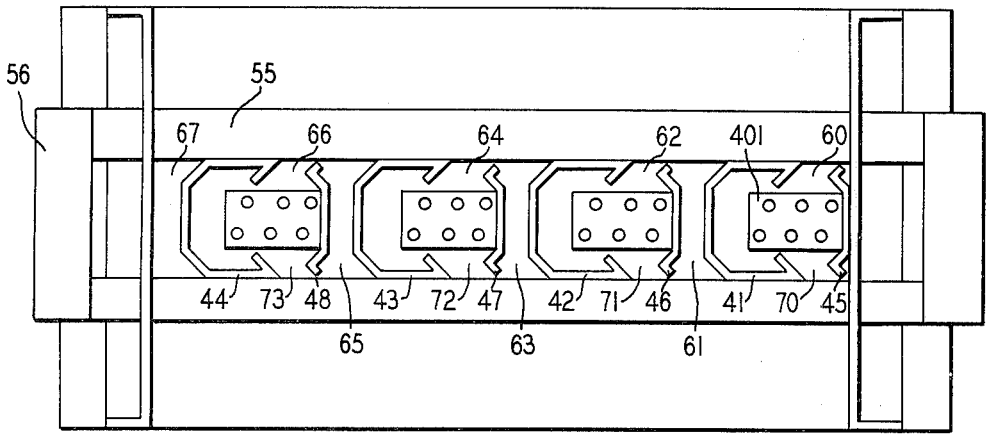
Figure 6C:
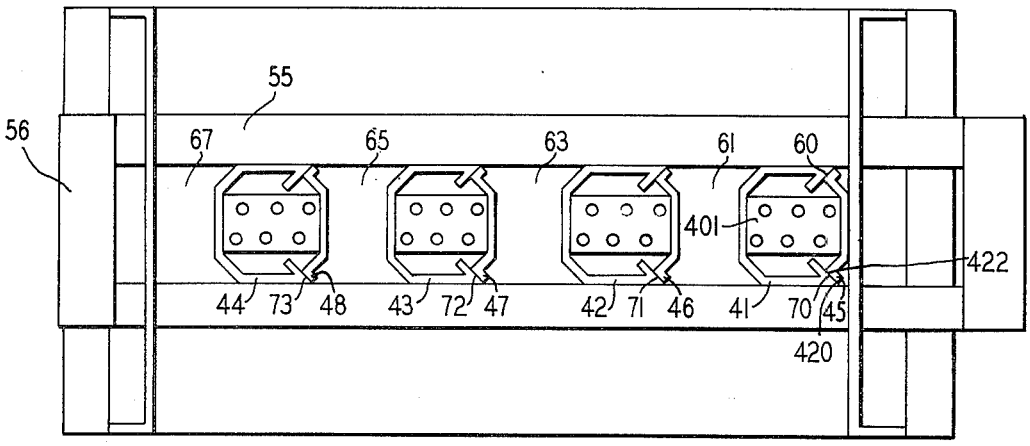
Figure 7:
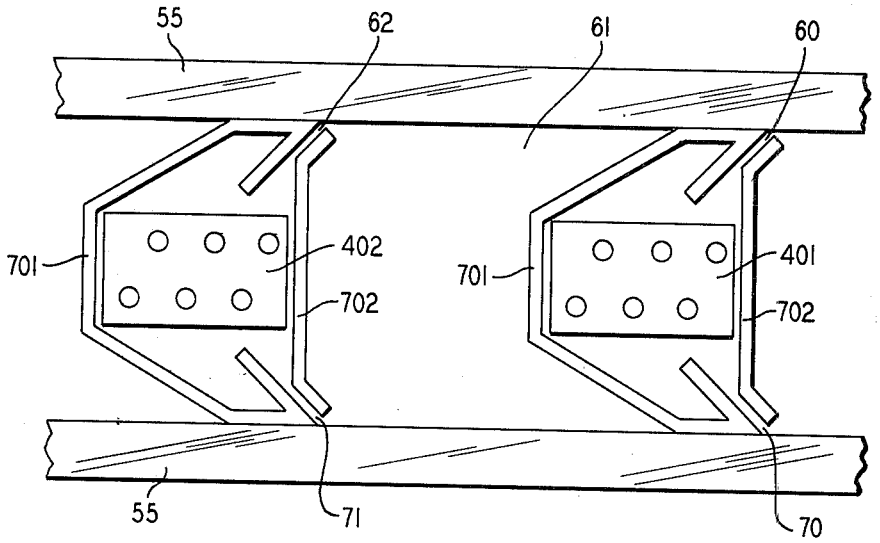
Figure 8:
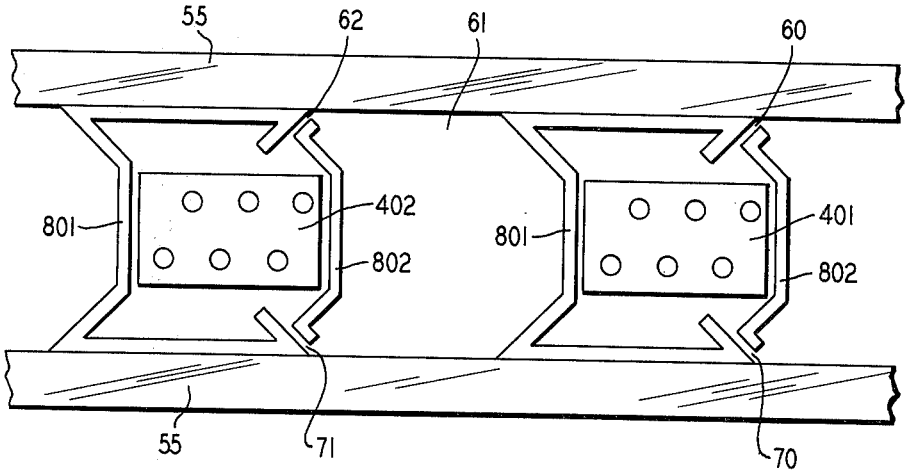
Figure 9:
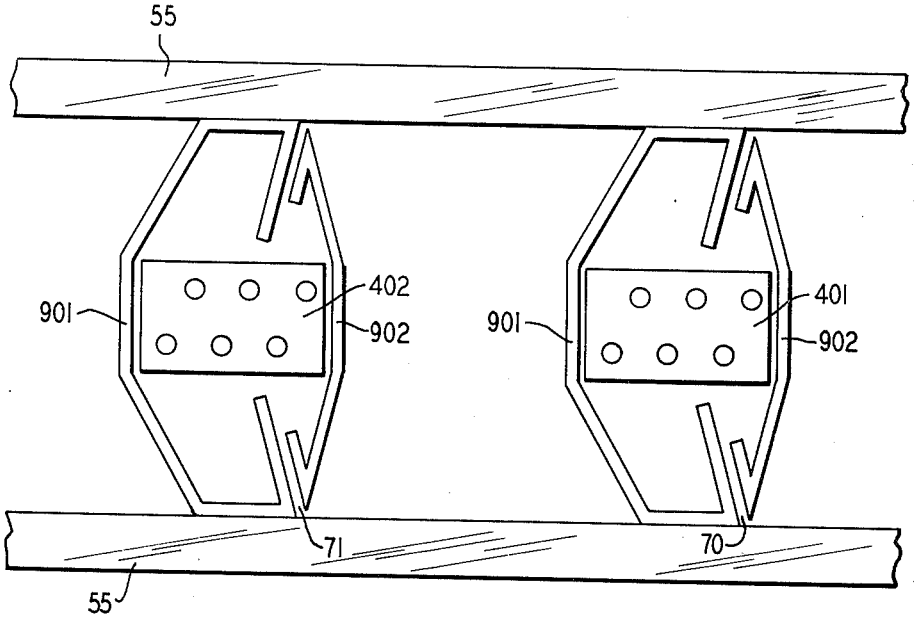
Figure 10:
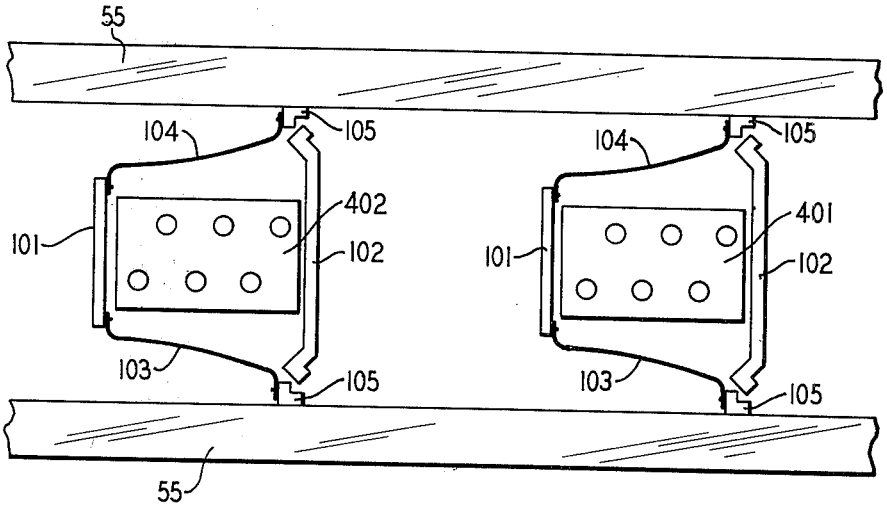

FIGS. 3, 3A, 3B, and 3C show details of the guide and support bearings;

FIG. 4 shows a single tube and fin group with a fixed baffle and a movable baffle of the associated damper;

FIG. 5 shows a plurality of movable damper baffles rigidly affixed to horizontal supports;

FIGS. 6A, 6B, and 6C show the movable baffles of the dampers assuming different positions;

FIGS. 7, 8, and 9 show alternate damper designs, each arranged to handle a different situation; and FIG. 10 shows an alternate damper arrangement.

GENERAL DESCRIPTION

Before entering into a detailed description of the operation of our damper arrangement a discussion of the overall operation of vertical tube face and bypass air treatment unit is in order. Such units are used to condition air flowing into a heating system by passing the incoming air through heat coils for the purpose of transferring to the incoming air a certain amount of heat energy. Several factors must be taken into account in such units. For example, since the final temperature of the air must be at a fixed level, say 70° Fahrenheit, the amount of heat energy transferred to the incoming air then is an inverse function of the ambient temperature of that air.

The manner in which temperature control of the air is then achieved is to proportion the incoming air so as to either pass through the unit in contact with the heating tubes or to pass through the unit between sets of such tubes. These passages are called the face and bypass passages or channels, respectively. Under such an arrangement the exact proportion of the air through each passage controls the final temperature of the air. Thus, if the air is to be heated to maximum capacity, all of the incoming air is channeled through the face passage and, if the incoming air is to be untreated, all of the air is channeled through the bypass passage. For intermediate situations some air is passed through each passage in a continuously variable manner dependent jointly upon the desired final temperaature and the ambient temperature.

DETAILED DESCRIPTION

Figure 1:
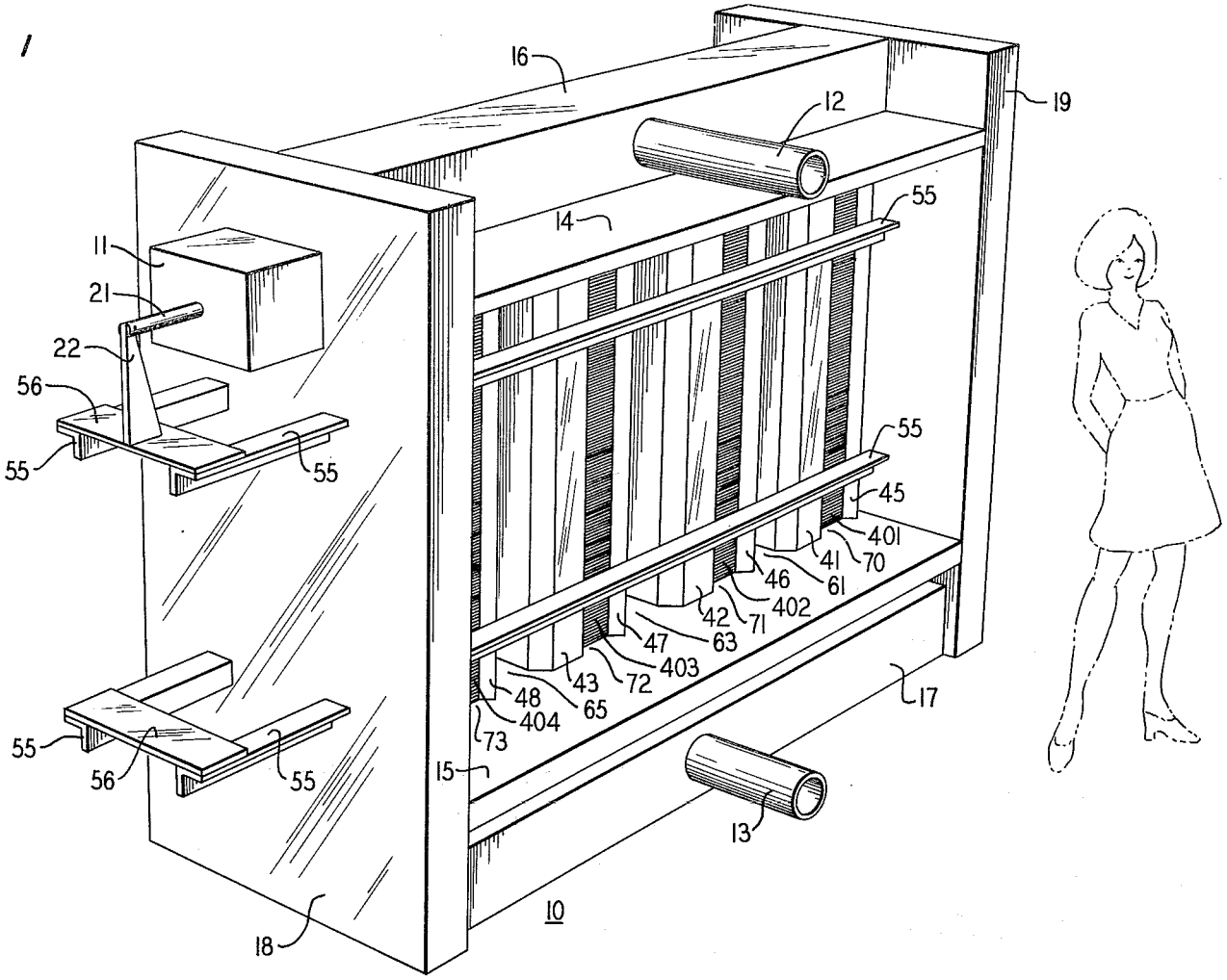
FIG. 1 is a front elevation of an integral face and bypass heater with the damper horizontal and vertical support member bearings removed shown in relation to the size of a person to give a perspective on size.

As shown in FIG. 1, vertical tube face and bypass unit 10 is constructed having sides 18 and 19 with upper and lower headers 16 and 17, respectively, connecting the sides. Header 16 is connected to steam intake pipe 12 while header 17 is connected to steam exhaust pipe 13. Connecting the heaters are a series of vertical tubes through which the steam or other energy transforming means passes. The tubes are arranged to form groups, each group surrounded by a series of heat transferring fins. The tubes of each group are separated from each other a distance sufficient to allow air to pass between the tubes and in contact with the tubes and fins or substantially in contact therewith.

FIG. 4 shows such a group of tubes 49 which are surrounded by fins 401. Also shown are the two baffle portions of the damper associated with the tube set. Damper baffle 45 is fixed with respect to the tube set, while damper baffle 41 is arranged to slide across the face of the tube set thereby controlling the size of opening 70 which opening controls the amount of incoming air passing through the face passage and contacting fins 401.

Each movable baffle, such as baffle 41, has a proximal edge 420, a distal edge 421, and a connecting portion 410. Each fixed baffle, such as baffle 45, also has a proximal edge 422, a connecting portion 415 and a distal edge 423. When the baffle portions are closed in full mating relationship, the respective proximal and distal edges of the mating pair are in contact with one another. The seal between the respective edges is away from the center line of fin set 401 so that air or other fluid striking the seal will force the movable baffle edge closer to the edge of the fixed baffle thereby further tightening the seal. Also with respect to FIG. 4 it is seen that air flowing perpendicular to the fin set through the apparatus is presented a relatively low or transparent profile by fixed damper baffle 45 while movable damper baffle 41 presents a relatively high profile to the movement of air. The importance of this arrangement will become more fully apparent from that which is to follow.

Returning to FIG. 1, a plurality of such fin and damper arrangements are spaced across the width of the headers between the side walls 18 and 19 of air treatment unit 10. Each fin group 401, 402, 403 and 404 has associated therewith a fixed damper baffle 45, 46, 47 and 48, respectively, and a movable damper baffle 41, 42, 43 and 44 (not shown), respectively. The movable damper baffles are affixed to channels 55 which are in turn secured to plates 56 as shown. Movement in a direction parallel to the face of the unit and to the right results in the lateral movement of each movable damper baffle which, in turn, decreases the size of each face passage opening 70, 71, 72 and 73.

Between each set of fins, such as between fins 401 and 402, there is a bypass passage, such as passage 61, which is defined by the fixed baffle 46 of one damper, and the movable baffle 41 of an adjacent damper baffle. Thus, as the damper control channels 55 move to the right, the movable damper baffles act to close the respective face passages and open the respective bypass passages proportionately to the movement of the channels. This exact operation will be more fully explained hereinafter.

Damper control channels 55 move laterally in response to mechanical force provided by motion source 11 and connecting arms 21 and 22. This source can be any one of a number of such sources, such as an hydraulic motor, pneumatic motor, or electric damper motor, operating under control of sensors to control the amount of heat to be transferred to the incoming air. The damper control channels are fixed to each movable baffle and act both to support the movable baffles and to laterally move them in a continuous manner.

Figure 2:
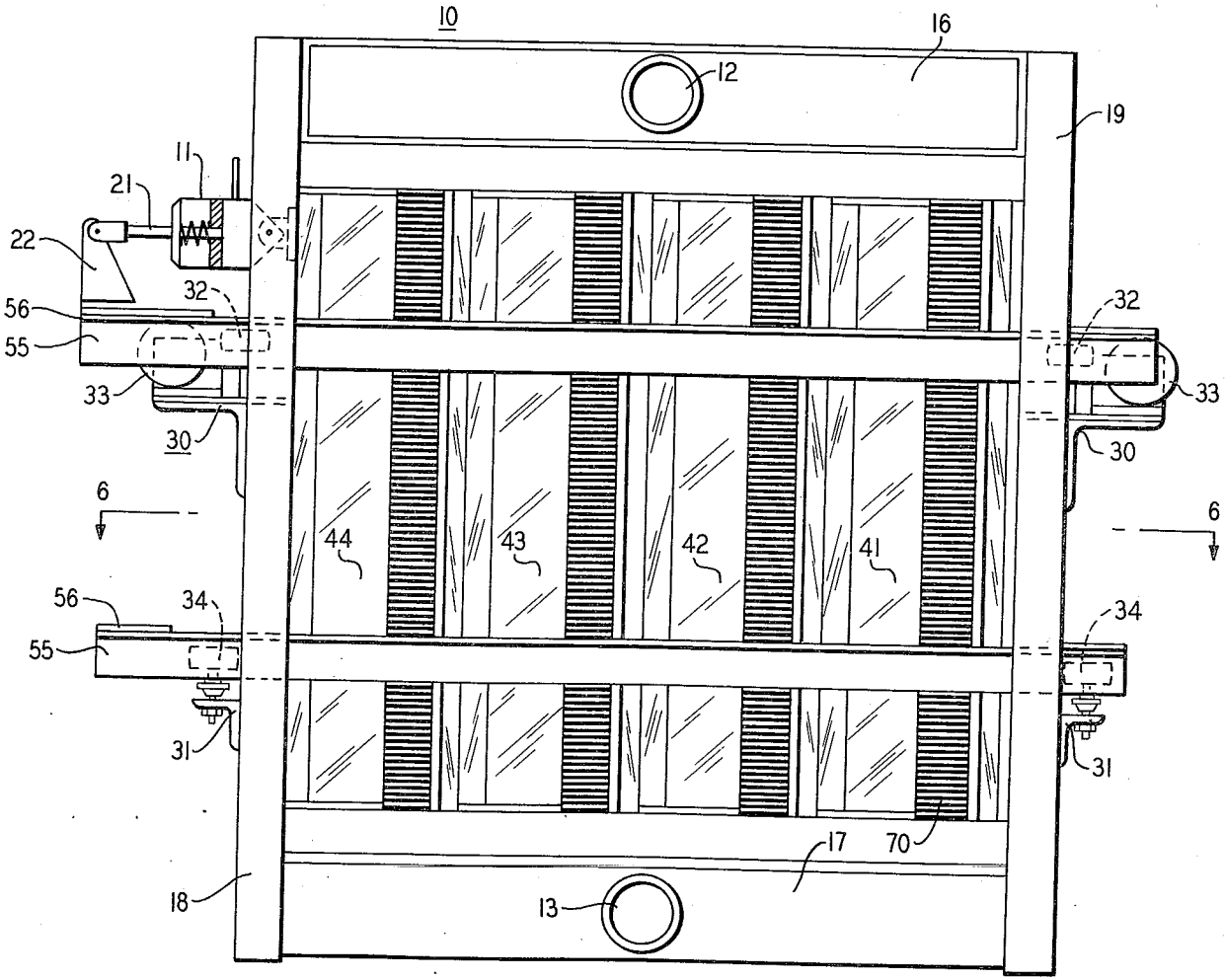
FIG. 2 is a front view of the heater with the bearings shown.
Figure 3:
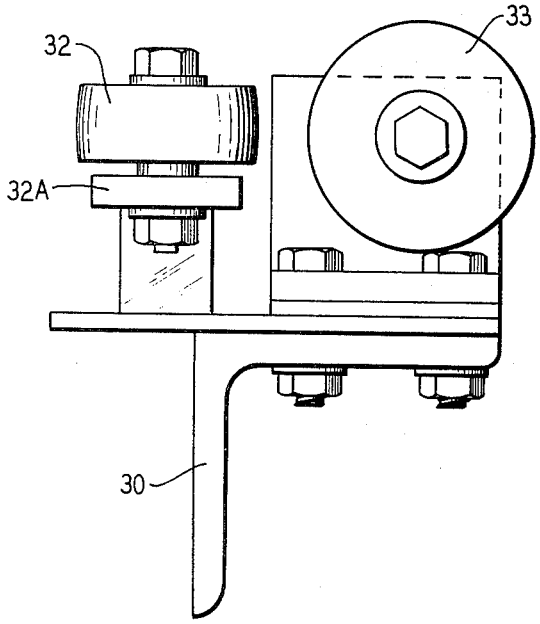
Figure 3A:
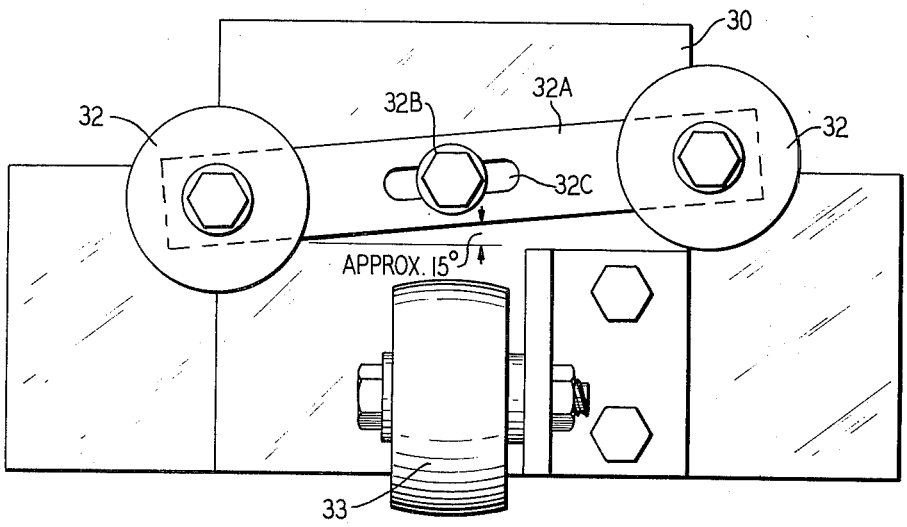
Figure 3B:
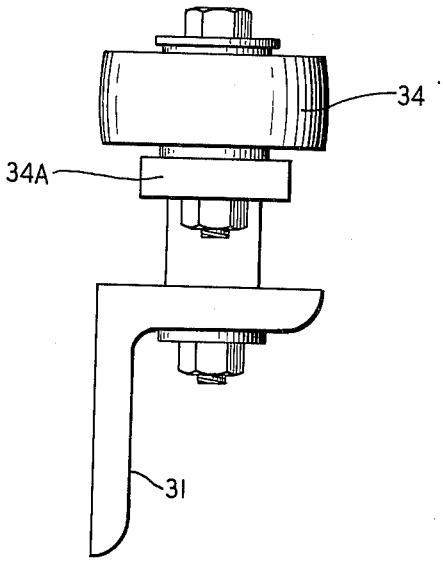
Figure 3C:
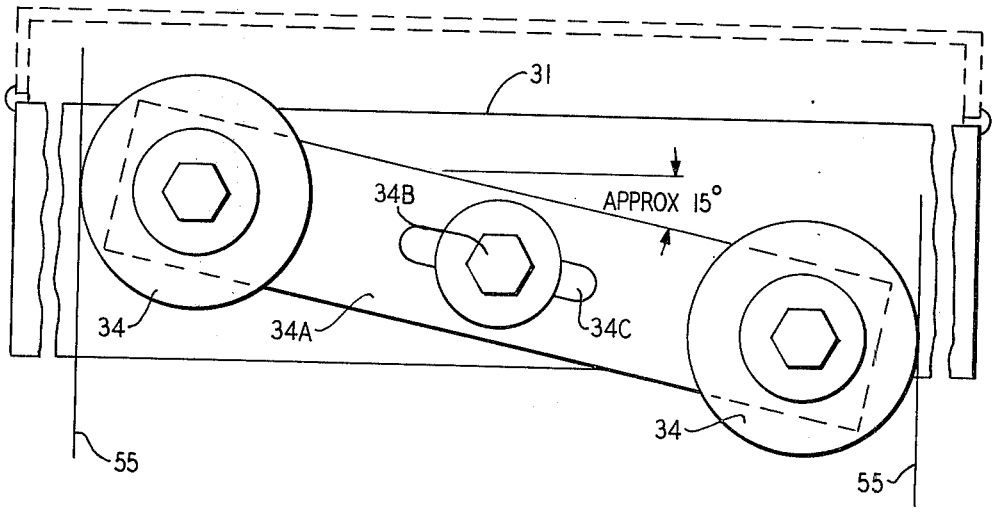

Turning now to FIG. 2, a full front view is shown detailing the manner in which damper control channels 55 are supported and guided by assemblies 30 and 31. These assemblies are detailed in FIGS. 3, 3A, 3B, and 3C where the supporting means are shown. With reference now to FIG. 3, the upper channels 55 are supported by bearing wheel 33 of assembly 30 each of which assembly is mounted on one side frame 18 or 19. Wheels 33 act to support upper channels 55 so that the movable dampers which are rigidly affixed thereto do not ride on the base of the apparatus but instead are free to move an axis thereof laterally across the apparatus along much in the same way as a sliding door moves. FIG. 3A is a top view of assembly 30 showing how forward and rearward motion of channels 55 is prevented by guide wheels 32 which can be adjusted to keep the channels in alignment. Since the entire movable assembly of dampers is rigid, it can be supported in a relatively few places as shown and thus the highest quality of support bearings can be used without adding substantially to the cost of overall assembly 10. FIGS. 3B and 3C detail assembly 31 which guides lower support channels 55.

As shown in FIG. 3C the overall length of the lower support and guide bar assembly 34A and guide wheels 34 is greater than the distance between the channels 55. The angle at which the guide bar is attached can then be varied (shown as 15°) to insure that the distance between the channels 55 is bridged even if it may be oversize or undersize due to manufacturing tolerances. Adjustments can be made to insure that there is no free play between the guide bar wheels and channels so that the channels can be exactly guided through out their lateral motion. The guide bar mounting hole 34C is slotted to provide exact alignment of the proximal and distal edges of the dampers and baffles and still eliminate free play between guide wheels and channels. Upper guide bar 32A, bolt 32B and slot 32C shown in FIG. 3A function in the same manner just described for the lower assembly.

As the term alignment is used it refers to the keeping of supports 55 in a fixed position relative to the fixed heat elements, such as element 401. To accomplish this supports 55 must not be allowed to move perpendicular to the lateral plane of these elements. Thus, with reference to FIG. 3C, supports 55 must not be allowed to move right or left across the page. It will be seen that, for any position of rod 34A, the far ends of wheels 34 will be fixed right or left with respect to the center of support 31. Supports 55 then cannot move either right or left, but are free to move up or down due to the fact that the up or down movement is controlled by the rotation of wheels 34. This up and down movement allows the supports to move laterally across the face of the unit thereby allowing the dampers to open or close. Once rod 34A is set, the supports 55 are not free to move perpendicular to the lateral movement and thus alignment is assured.

Turning to FIG. 5, the assembly of movable dampers is shown with support channels 55 being rigidly fixed to each movable damper baffle, such as baffles 41, 42, 43 and 44, by welds, such as weld 57, or by other means. The baffles 41, 42, 43 and 44 are in fixed relationship to each other and are each shaped substantially as a U with the open end adapted to fit around the fins of a group of heating tubes. Each set of channels 55 has a plate 56 at the ends thereof which plate rests on support bearing wheels 33, as shown in FIGS. 2, 3 and 3A, thereby supporting the entire assembly. Wheels 32 exert pressure on the inside of upper channels 55 while wheels 34 do the same thing for lower channels 55. Thus the entire assembly is free to move laterally with respect to overall assembly 10 under control of motive source 11 as shown in FIG. 2.

Each movable damper baffle has a proximal edge, such as edge 420, a distal edge, such as edge 421 and a U-shaped connecting body 410. The proximal and distal edges have the same shape so that air can move through the apparatus in either direction, the shape being determined by the mating relationship to be assumed by each movable damper baffle with its associated fixed damper baffle in the manner to be discussed.

FIG. 6A is a top view taken through line 6—6 of FIG. 2 and shows the dampers in the fully open position with channels 55 moved fully to the left. In this position there is an open face passage 70 for incoming air to follow which face passage is defined by the proximal edge 420 of movable baffle 41 and the proximal edge 422 of fixed baffle 45. This opening serves to channel the incoming air through fin set 401 and out through face opening 50 formed between distal edge 421 of movable baffle 41 and distal edge 423 of fixed baffle 45. Note that baffles 41 and 45 are a pair and are associated with the same fin set 401. Note also that, while in this position, the bypass passage 61 between fin sets 402 and 401 is blocked by the side portions of movable baffle 41 in contact with fixed baffle 46 of the next adjacent fin set. This configuration is repeated for all fin sets and thus all incoming air is forced to pass through and substantially contact the faces of the fin sets thereby providing maximum heat transfer to the incoming air.

In FIG. 6B, channels 55 have moved to the right a distance thereby causing all of the movable baffles to also move to the right. In this position, face opening 70 has been reduced in size thereby limiting the amount of air which is allowed to pass through fin set 401. At the same time the sides of movable baffle 41 move away from adjacent fixed damper 46 thereby creating a bypass passage 61 through which air can flow. Since the size of this opening is in inverse proportion to the size of the face opening, a constant volume of air is allowed to pass through the apparatus.

The shape of the sides of each movable damper baffle whereby the opening into the bypass passages is larger than the actual passage serves to add impedance to the air flow so that air flowing through the bypass passage meets the same resistance as air flowing through the face passage.

In FIG. 6C channels 55 have moved fully to the right thereby causing opening 70 of the face passages to close thereby blocking all air from passing through the fin set. At the same time bypass passage 61 is fully open so that all incoming air passes through that channel and passes through the apparatus unheated. Note that in this position air incoming to the dampers is forced against the proximal sealing edges 420 and 422 of the dampers thereby forcing them to seal tighter. This is due to the mating shape of the proximal and distal edges of the respective mating baffles and also due to the fact that the actual seal is offset from the center line of each fin set.

Since all pivoting of dampers has been eliminated and the entire damper section made rigid once the mating baffles are aligned, a step taken before the movable baffles are rigidly affixed to channels 55, all adjustments of baffle movement are accomplished external to the apparatus by aadjusting one of the wheels 32, 33 or 34 as shown in FIGS. 3, 3A, 3B and 3C. Thus, adjustments may be made while the apparatus is functioning at operating temperature thereby eliminating the need to close down and cool the apparatus in order to adjust the internally pivotable dampers of the prior art.

Accurate temperature control is achieved by controlling the amount of air which is allowed to pass through each face or bypass passage by precisely controlling the relative placement of the dampers.

While the dampers discussed above have been shaped generally like a U, the invention is certainly not limited to such a geometry but, in fact, can be practiced with dampers having many shapes, each such shape being suitable for a particular purpose. For example, in FIG. 7 there is shown a damper shape for use where a lower air flow resistance through the face passages is desired. FIG. 8 indicates a damper shape for increased air flow resistance through the bypass passages. FIG. 9 indicates a more streamlined damper shape for reducing air flow resistance through both face and bypass passages. Each of these damper arrangements utilizes the basic concept of a slidable damper section moving into contact with a fixed damper section in order to create bypass passages and face passages dependent upon the relative position of the respective dampers.

In FIG. 10 there is shown an alternate damper arrangement using membrane baffles. In this embodiment fixed baffle 102 is arranged as discussed above. Baffle 101 is arranged in fixed relationship with the heating coil 402 and membranes 103 and 104 are mounted to each fixed portion 101. When supports 55 move to the right to open the face passages the membranes 103 and 104 fold back allowing air to come into contact with heating coils 402. The membranes are connected to supports 55 at points 105.

CONCLUSION

While we have shown the dampers moving laterally under control of rigid supports which are in turn moved by a single power source, it should be understood that multiple power sources can be used, one on the top pair of support rails and one on the lower pair of support rails. In addition, the support rail pairs can be connected together outside the casing and a single power source used for lateral movement.

Because of the ease of implementing our invention and the reduced manufacturing costs involved, it is anticipated that many variations of our teachings will be undertaken all without departing from the spirit and scope of the invention taught.

What is claimed is:

1. In a face and bypass apparatus where the energy level of air or other fluid is to be changed by moving the air therethrough in selective contact with a plurality of heat unit transfer means which means are spaced apart along an axis of said apparatus perpendicular to the direction of movement of said air where selectivity is accomplished by proportionally channeling said moving air through passages into face contact with said heat transfer means or through passages between said heat transfer means which bypass said heat transfer means, said selective proportioning being accomplished by a plurality of dampers, said dampers comprising a plurality of first damper baffles each associated with an individual one of said heat unit transfer means and mounted in fixed relationship to said associated heat unit transfer means and on a side thereof, perpendicular to the said flow of air, each said first baffle having a relatively transparent profile to said flow of said air through said apparatus in the direction of said flow, a plurality of second damper baffles each being associated with a mating one of said first damper baffles, all of said second baffles being rigidly affixed to a support and each mounted so as to be on the opposite side of the heat unit transfer means associated with the mating one of said first damper baffles, each such second baffle having a relatively high profile to the said flow of air through said apparatus in the direction of said flow, and means for moving said second baffles across said apparatus and parallel to said axis in a manner perpendicular to said flow of air through said apparatus so as to establish exclusively said bypass passages through said apparatus when said support is in one position and to establish exclusively said face passages through said apparatus when said support is in a second position.

2. The invention set forth in claim 1 wherein said moving means includes at least one guide wheel adapted for controlling the lateral movement of said second baffle support, said guide wheel bearing against said suport.

3. The invention set forth in claim 2 wherein said moving means further includes a wheel for supporting said support while allowing said support to move laterally across said apparatus.

4. The invention set forth in claim 1 further comprising means operable when said second baffle is in a position between said first and second positions for establishing both bypass and face passages through said apparatus, the opening size of which are inversely proportional to each other and dependent on the relative distance between the mating damper baffles.

5. The invention set forth in claim 1 wherein said second baffle support comprises a pair of supports, one mounted on each side of said passages, and wherein said moving means includes a pair of guide wheels adapted for controlling the lateral movement of said pair of supports, each of said guide wheels bearing against one of said supports.

6. The invention set forth in claim 5 wherein said pair of guide wheels are supported at the ends of a rod, said rod being longer than the distance between said supports and adapted for adjusting said pair of guide wheels so as to insure that said mating baffles are in alignment with each other.

7. In a face and bypass apparatus where the energy level of air of other fluid is to be changed by moving the air therethrough into face contact with a plurality of vertically disposed and spaced apart energy transfer means or by moving said air through said apparatus in a bypass manner between said spaced apart vertical energy transfer means, a damper arrangement for selectively proportioning said air between said face contact and said bypass manner, said damper arrangement comprising a plurality of first baffles each associated with one of said vertically disposed energy transfer means, each said damper having a proximal edge, a distal edge and a side portion connecting said edges, each said baffle fixed in a position with said side portion parallel to an associated one of said energy transfer means and being vertically disposed along the entire vertical length of said associated energy transfer means, a plurality of second baffles, each one associated with one of said energy transfer means, each said baffle having a proximal edge, a distal edge and a central portion connecting said edges, each said second baffle fixed in a position with respect to each other said second baffle, each said second baffle being vertically disposed along the entire vertical length of said associated energy transfer means, and continuously variable means for moving said second baffles from a first position where said proximal and distal edges, respectively, of each said first and second baffle associated with the same energy transfer means are in mating contact with each other so as to prevent said air from coming into face contact with said energy transfer means and to force said air to pass through said apparatus through bypass passages established between the connecting portion of a first baffle and the connecting portion of an adjacent second baffle, to a second position where said central portions of said adjacent first and second baffles mate to prevent the passage of said air through said bypass passages and to force said air to pass between the proximal and distal edges, respectively, of said mating baffles thereby coming into face contact with said energy transfer means.

8. The invention set forth in claim 7 wherein said continuously variable means includes a rigid support disposed along the axis of said energy transfer means, each said second baffle being rigidly connected thereto.

9. The invention set forth in claim 8 further comprising means for entirely supporting and guiding said second baffles from points outside of said air flow through said apparatus.

10. The invention set forth in claim 6 wherein said supporting means includes at least one guide wheel adapted for controlling the lateral movement of said second baffle rigid support said guide wheel bearing against said support.

11. The invention set forth in claim 10 wherein said supporting means further includes a wheel for supporting said rigid support while allowing said rigid support to move laterally across said apparatus.

12. The invention set forth in claim 8 wherein said rigid support includes a pair of supports, one of said pair of supports rigidly affixed to said proximal ends of said second baffles and the other of said pair of supports rigidly affixed to said distal ends of said second baffles, said supporting means including a pair of guide wheels adapted for controlling the lateral movement of said pair of supports, each of said wheels bearing against one support of said pair of supports, and wherein said pair of guide wheels are supported at the ends of a rod, said rod being longer than the distance between said rigid supports and adapted for adjusting said pair of guide wheels so as to insure that said mating baffles are in alignment with each other.

13. The invention set forth in claim 9 further comprising means operable when said support is in a position between said first and second positions for establishing both bypass and face passages through said apparatus, the opening size of which are inversely proportional to each other and dependent on the relative distance between the mating damper baffles.

14. Dampers for use in an apparatus for conditioning the flow of fluid therethrough where said conditioning is accomplished by moving said fluid in contact with a plurality of energy transfer means, said energy transfer means arranged in a vertical manner and grouped into sets, the sets defining first passages where fluid passing through said apparatus contacts said energy transfer means and second passages where fluid passes through said apparatus without contacting said energy transfer means, said dampers arranged to selectively proportion fluid flow between the said passages, each said damper comprising a first baffle arranged for mounting in a fixed relationship with each group of said energy transfer means, between said group and an adjacent said passage, a second baffle arranged for mounting in movable relationship with each group of energy transfer means, each said second baffle arranged for a first mating relationship with the first baffle associated with the same energy transfer means and a second mating relationship with the first baffle associated with an immediately adjacent energy transfer means, and means for interconnecting and supporting all of said second baffles in fixed relationship to each other, said means operable for moving said second baffles into said first mating relationships thereby closing said first passages and operable for moving said second baffles into said second mating relationships thereby closing said second passages.

15. The invention set forth in claim 14 wherein said interconnecting and supporting means includes a rigid support disposed along the axis of said energy transfer means, each said second baffle rigidly connected thereto.

16. The invention set forth in claim 15 wherein said rigid support is supported and guided entirely from outside of said fluid flow through said apparatus.

17. The invention set forth in claim 16 wherein said moving means includes at least one guide wheel adapted for controlling the lateral movement of said second baffle support, said guide wheel bearing against said support.

18. The invention set forth in claim 17 wherein said moving means further includes a wheel for supporting said support while allowing said support to move laterally across said apparatus.

19. In a face and bypass apparatus where the energy level of air or other fluid is to be changed by moving the air therethrough into face contact with a plurality of vertically disposed and spaced apart energy transfer means or by moving said air through said apparatus in a bypass manner between said spaced apart vertical energy transfer means, a damper arrangement for selectively proportioning said air between said face contact and said bypass manner, said damper arrangement comprising a plurality of first baffles each associated with one of said vertically disposed energy transfer means, each said damper having a proximal edge, a distal edge and a side portion connecting said edges, each said baffle fixed in a position with said side portion parallel to an associated one of said energy transfer means and being vertically disposed along the entire vertical length of said associated energy transfer means, a plurality of second baffles, each one associated with one of said energy transfer means, each said baffle having a proximal edge, a distal edge and a central portion connecting said edges, each second baffle being vertically disposed along the entire vertical length of said associated energy transfer means, a rigid support disposed along the axis of said energy transferring means adapted for supporting and guiding said first baffles, and continuously variable means including said rigid support for moving said second baffles from a first position where said proximal edge and distal edge, respectively, of each said first and second baffle associated with the same energy transfer means are in mating contact with each other so as to prevent said air from coming into face contact with said energy transfer means and to force said air to pass through said apparatus through bypass passages established between the connecting portion of a first baffle and the connecting portion of an adjacent second baffle, to a second position where said central portions of said adjacent first and second baffles mate to prevent the passage of said air through said bypass passages and to force said air to pass between the proximal and distal edges, respectively, of said mating baffles thereby coming into face contact with said energy transfer means.

* * * * *